United States Patent [19]

Fernbaugh

[11] 4,069,919

[45] Jan. 24, 1978

[54] SECURITY SYSTEM FOR MERCHANDISE DISPLAY

[76] Inventor: Francis W. Fernbaugh, 92 S. Newland Court, Lakewood, Colo. 80226

[21] Appl. No.: 730,957

[22] Filed: Oct. 8, 1976

[51] Int. Cl.[2] ..... E05B 73/00

[52] U.S. Cl. ..... 211/4; 70/62; 340/280

[58] Field of Search ..... 211/4, 5, 6, 7, 8, 9, 211/123, 124; 70/26, 30, 38 A, 39, 49, 58, 59, 62, 439; 340/280

[56] References Cited

U.S. PATENT DOCUMENTS

| | | | |
|---|---|---|---|
| 514,584 | 2/1894 | Ahlers | 340/280 |
| 699,971 | 5/1902 | Poschmann | 211/124 |
| 780,985 | 1/1905 | Fossum | 211/4 |
| 883,335 | 3/1908 | O'Connor | 340/280 |
| 1,204,813 | 11/1916 | Murray | 211/8 |
| 1,221,584 | 4/1917 | Patrick | 211/8 |
| 2,395,131 | 2/1946 | Lukeman | 70/59 |
| 3,400,812 | 9/1968 | Snow | 211/4 X |
| 3,567,034 | 2/1971 | Mozelsio | 211/7 |
| 3,596,265 | 7/1971 | Garland | 340/280 |
| 3,606,948 | 9/1971 | Strang | 211/4 |
| 3,690,130 | 9/1972 | Eutzler | 211/4 X |
| 3,985,183 | 10/1976 | Fernbaugh | 211/7 |

FOREIGN PATENT DOCUMENTS

| | | | |
|---|---|---|---|
| 543,080 | 1/1932 | Germany | 211/4 |
| 50,903 | 3/1919 | Sweden | 70/59 |
| 114,803 | 5/1926 | Switzerland | 340/280 |
| 3,264 of | 1908 | United Kingdom | 211/4 |

*Primary Examiner*—Marion Parsons, Jr.
*Assistant Examiner*—Thomas J. Holko
*Attorney, Agent, or Firm*—Sheridan, Ross, Fields & McIntosh

[57] ABSTRACT

The security system generally includes an elongate tubular member provided with a row of spaced apertures and a locking member movably mounted within the tubular member and formed with a series of pockets. Elongate flexible guard members with enlarged heads at each end are passed through a closed loop portion of the article and the heads are inserted through a selected pair of adjacent apertures and into the corresponding pockets. Relative movement of the tubular member and locking member reduce the effective exit area and all heads are locked in the tubular member simultaneously. An electrical circuit is connected with an alarm device and with the various pockets. When both heads of the guard member are in a selected pair of pockets or both removed, the circuit is complete. When one head is in a pocket and the other is not, or if a cable is cut by a shoplifter, the circuit is open. The alarm device is arranged to emit a visual and/or audio warning signal when the system is in locked condition and an open circuit occurs.

16 Claims, 6 Drawing Figures

SECURITY SYSTEM FOR MERCHANDISE DISPLAY

BACKGROUND OF THE INVENTION

1. Field of the Invention

This invention relates to a merchandise security system, and more particularly to a security system for simultaneously locking a plurality of garments or other articles of merchandise on a single rack.

2. Description of the Prior Art

The theft of merchandise, such as garments, from public places is a chronic problem to which no entirely satisfactory solution has been found. A number of anti-theft devices have been devised for use in restaurants, cloak rooms, clothing stores and the like. Examples of such devices are found in U.S. Pat. No. 610,372 to Sanford; U.S. Pat. No. 1,043,351 to Paskell; U.S. Pat. No. 1,040,181 to Frank; U.S. Pat. No. 1,618,885 to Minor; U.S. Pat. No. 3,378,144 to Webster; and U.S. Pat. No. 3,606,948 to Strang. Although each of the devices illustrated in the above-mentioned patents is able to provide the desired security, there are a number of reasons why the use of these inventions generally have not met with wide acceptance.

In the first place, most such devices are unduly complicated and cumbersome and, therefore, the time and difficulty required in using them is too great to be acceptable. Secondly, such devices are often very costly and, therefore, are not justified even though the reduction of the theft of garments may result. Finally, in an establishment like a clothing store it is highly inconvenient to unlock each item of merchandise whenever a customer wishes to try it on or examine it and then re-lock it after he is finished and then perhaps unlock and re-lock additional garments or other articles from the same rack for the same customer. In addition, when a number of customers and salesmen are on the floor the confusion and difficulties are compounded by this sort of apparatus. The result has been that stores for the most part have not invested in such equipment even though the theft of merchandise continues and increases at an alarmingly high rate. With smaller merchandise, such as radios and the like, it is often necessary to keep it in a locked cabinet from which it must be removed whenever a customer wishes to examine it. This procedure is troublesome and unsatisfactory to both the customer and the sales personnel.

CROSS REFERENCE TO RELATED APPLICATION

This application is related to my previously filed U.S. application, entitled, "Merchandise Rack Security Device," U.S. Ser. No. 578,418, filed May 19, 1975, now U.S. Pat. No. 3,985,183, which discloses and claims a companion development.

SUMMARY OF THE INVENTION

In accordance with the present invention, the security system generally comprises an elongate tubular member provided with a plurality of longitudinally spaced apertures through its wall and a locking member movably mounted in the tubular member and extending throughout the major portion of its length, the locking member being provided with a plurality of radially directed pockets longitudinally spaced to lie in registry with the apertures when the locking member is in a first position with respect to the tubular member. Actuating means are provided to move the locking member between its first position and a second position in which the pockets are mismatched with the apertures to provide a locking function.

A plurality of guard members are provided, each with an enlarged head at each end. Each guard member is a slender, elongate, and flexible strand and is adapted to be passed through a sleeve or armhole of a garment or through a handle or other closed loop portion of such articles as purses, portable radios and the like. The two heads are then inserted through a selected pair of adjacent apertures in the tubular member and into the corresponding registered pockets, the group constituting a cooperative pair of securing devices. While the system remains unlocked, the heads are releasably retained in the pockets by flexible lips on the pockets, by magnets, or otherwise. Ordinarily only one head will be removed to release an article, but both heads may be readily pulled out if it is desired to keep the guard member with the article.

In order to secure the heads in position an actuating means is provided which moves the locking member relative to the tubular member from its first position in which the pockets are in registry with the apertures to its second position in which the pockets are mismatched with the apertures and the effective exit opening is smaller than the heads so that they are all simultaneously locked in position. The actuating means may be electrical or mechanical but is preferably the latter. To prevent unauthorized release movement of the locking member, the actuating means preferably is provided with a key lock, the store personnel retaining individual keys on their persons. Since the system works in a unitary manner, it may be used with a single guard member with its heads occupying only two adjacent pockets or with as many guard members as the total structure will accommodate.

An alarm device with suitable circuitry is provided to emit a warning signal when the system is locked and one head of a guard member has been left out of its pocket or the strand of a guard member has been cut or broken. The alarm device is suitably electrically powered and is of the type which emits a signal when an open circuit occurs.

The circuitry includes a series of slender elongate resilient conductors individually mounted adjacent their mid portions in end-to-end relation in the locking member, with an end portion of one conductor overlying the inner end of a first pocket of a cooperative pair and an end portion of the next conductor overlying the inner end of the second pocket of the same pair, the end portions of the two conductors meeting in conductive contact at a locus between the first and second pockets. A first terminal on the alarm device is connected to the first conductor in the series and a return circuit extends between the last conductor and a second terminal on the alarm device. When the actuating means moves to unlocking position it cuts the supply power to disable the alarm device. When it moves to locking position it reconnects the supply power and enables the alarm device. With no guard members connected in any pockets there is a complete circuit and the alarm device remains inactive with the system in locking condition.

When an operator inserts one head of a guard member in a pocket and neglects to insert the other, and then actuates the locking member, the inserted head seats deeply enough to spring the end of the associated conductor inward away from the adjacent conductor end to cause an open circuit, which causes the alarm device to emit a warning signal.

The guard members comprise strands of conductive metal, and when the heads are inserted in the pockets the ends of a strand make electrical contact with their respective conductor end portions. Hence, when both heads are properly inserted they spring the conductor ends apart to open the circuit, but since the strand ends are in contact with both conductors, the circuit is now completed from one conductor to the next along the path through the guard member, and the alarm device remains inactive. If a shoplifter attempts to steal an article from the locked system by cutting a guard member cable, he produces an open circuit and the alarm device will immediately emit a warning signal.

Since the tubular member is preferably a length of steel tubing of substantial rigidity, it may be provided near its ends with elongate vertical floor standards so that it can serve as a primary rack for supporting the articles on display.

BRIEF DESCRIPTION OF THE DRAWINGS

Various other advantages and features of novelty will become apparent as the description proceeds in conjunction with the accompanying drawings, in which.

DESCRIPTION OF PREFERRED EMBODIMENTS

Figure 1:
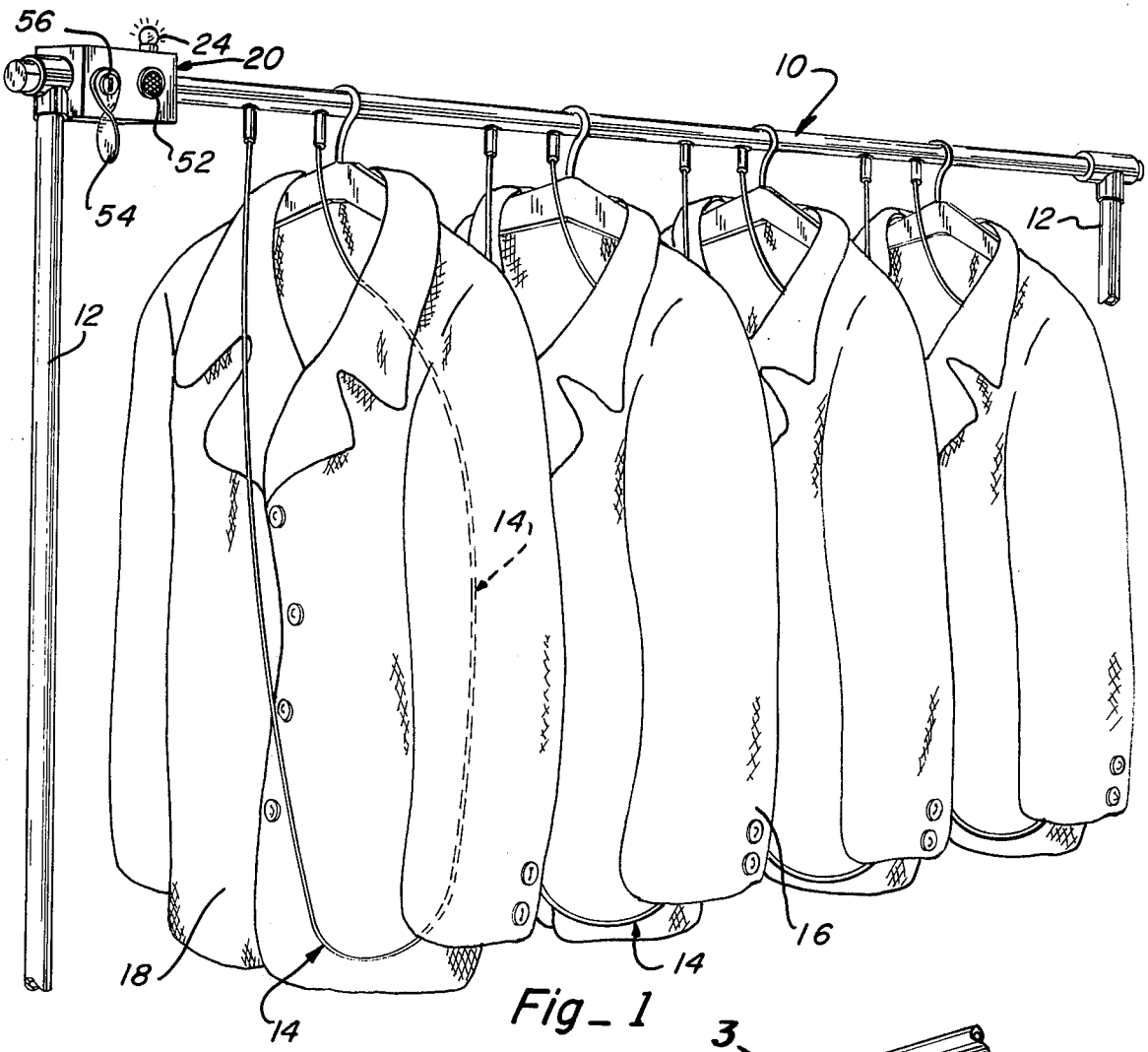
FIG. 1 is a perspective view of a garment rack incorporating the system of the invention.

The system is generally shown in one embodiment in FIG. 1, in which an elongate tubular member 10 is provided adjacent each end with an elongate vertical floor standard 12 to enable it to serve as a primary rack for supporting garments or the like in a merchandise display. A plurality of individual elongate flexible guard members 14 are provided, and each guard member is passed through a closed loop portion, such as the sleeve 16, of the garment 18. The two ends of each guard member are then inserted through openings in member 10 and locked in position by means described hereafter, to prevent unauthorized removal of the articles of merchandise from the display. An alarm device 20 provided with an audio signal unit 22 and a visual signal unit 24 is conveniently mounted adjacent one end of member 10 although it may be located elsewhere if desired.

Figure 2:
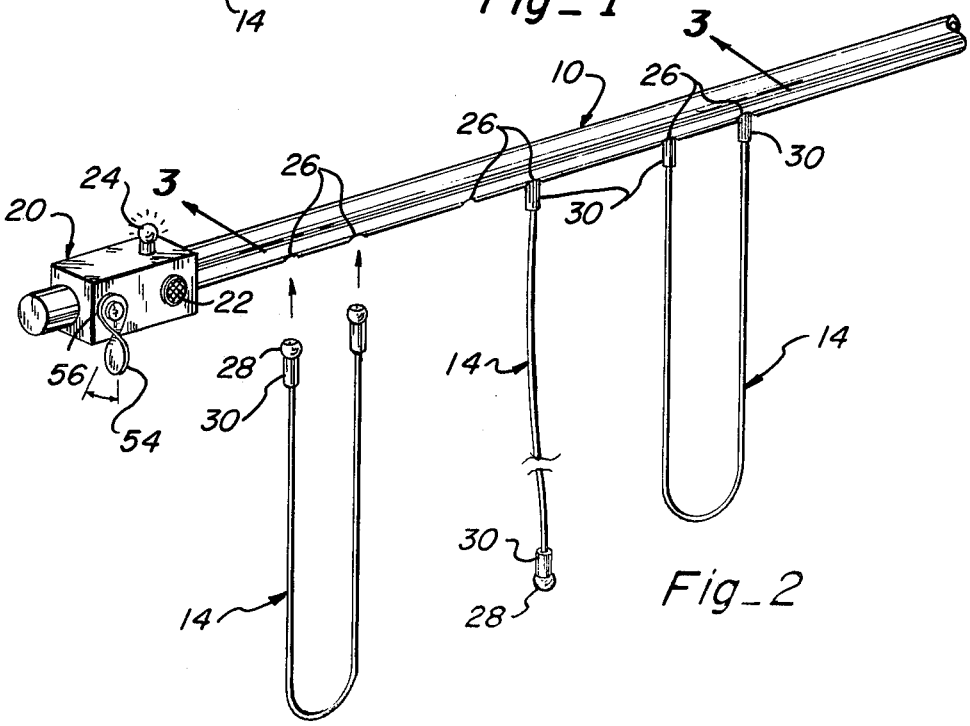
FIG. 2 is a view similar to FIG. 1 showing guard members in different positions.
Figure 3:
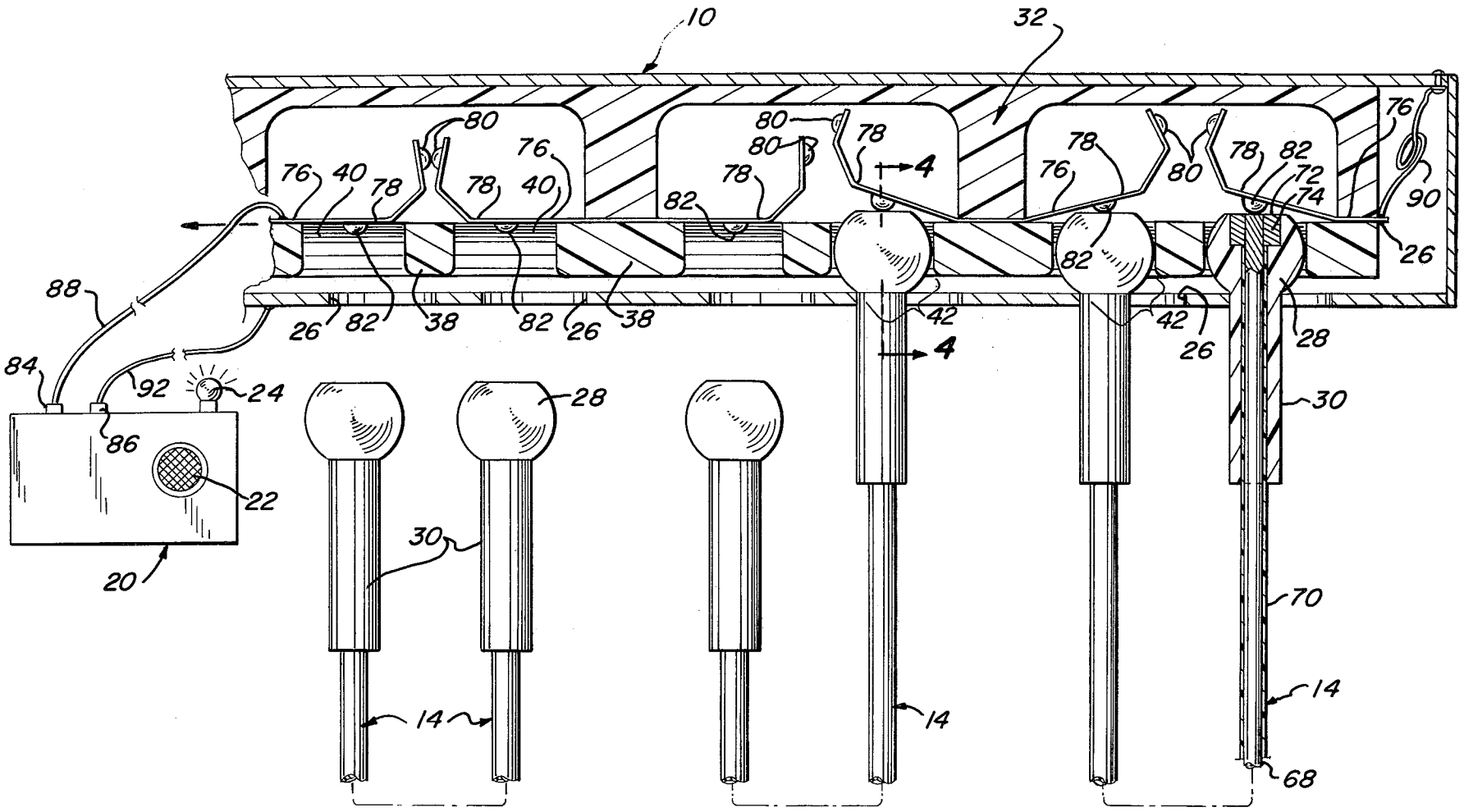
FIG. 3 is a partly sectional view taken on line 3—3 of FIG. 2.

FIG. 2 is a diagrammatic representation of the system with the guard members in three possible modes of operation. The member 10 is provided with a plurality of longitudinally spaced apertures 26 extending through its wall. Each guard member is provided at each end with an enlarged head 28, preferably spherical, having an integral stem 30 overlying the end portions of the member and serving as grips for inserting or removing the heads from the tubular member. The first guard member is shown as being entirely free of the tubular member with the heads about to be inserted. The second guard member is shown with one head inserted and the other head hanging free, while the third guard member is shown with both heads inserted to be locked in place and prevent unauthorized removal of a garment secured thereby. FIG. 3 shows the details of the locking mechanism located inside tubular member 10, with the guard members and heads in the same modes as in FIG. 2.

An elongate locking member 32 is movably mounted in tubular member 10 and may be rotated about its longitudinal axis to perform its function but is preferably connected to an actuating means to be moved axially through a predetermined distance. Member 32 is formed in two or more parts for feasibility of manufacture and assembly. It is of sufficient length to extend throughout the major portion of the length of the tubular member. A body portion 34, FIG. 4, carries depending side walls or lips 36 and abutments 38, FIG. 3, which define a plurality of longitudinally spaced pockets 40 along the length of member 32, the pockets opening both inward and outward. The spacing of the pockets corresponds to the spacing of the apertures. Member 32 is shown in FIG. 3 in a leftward location which is its second, or locking, position. When it is moved rightward through a predetermined distance it will be in its first, unlocking, position, and each pocket will be in registry with one of the apertures.

Figure 4:
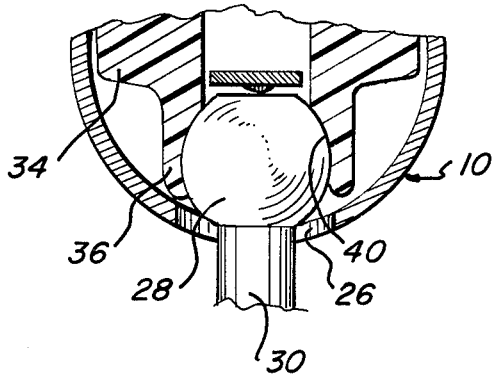
FIG. 4 is a partly sectional view taken on line 4–4 of FIG. 3.

The pockets may be completely spherical but as shown they have a generally rectangular horizontal cross section, the abutments 38 having straight walls and the lips 36 being horizontally cylindrical. Lips 36 have a curvature corresponding to that of the spherical heads, as seen in FIG. 4 and the entrance openings 42 are smaller than the lateral dimensions of heads 28. The body portion 34 is made of a strong but resilient plastic, such as Delrin, and lips 36 may be spread sufficiently to admit the heads without the use of undue force. Thus they will hold the heads in place without locking, but the heads may be readily pulled out when desired.

To make use of the system, the actuating means is operated to move the locking member to its first position with the pockets 40 in registry with their corresponding apertures. Each successive two apertures together with their corresponding pockets constitute a cooperative pair of securing devices, such as the first two shown at the left of FIG. 3, and each successive set constitutes another cooperative pair. When the two leftward heads 28 are inserted through the first two apertures and into the first two pockets, member 32 is moved to the left. When it is in its second position, the pockets will be in displaced relation with the apertures and the heads will be in the position indicated in the right portion of FIG. 3. Thus the locking means has moved into an interference position with the heads and has reduced the effective exit paths 42 to sizes less than the sizes of the heads and they cannot be removed. When the locking member is returned to its first position all of the pockets will be in registry with their respective apertures and any or all of the heads may be removed.

Figure 5:
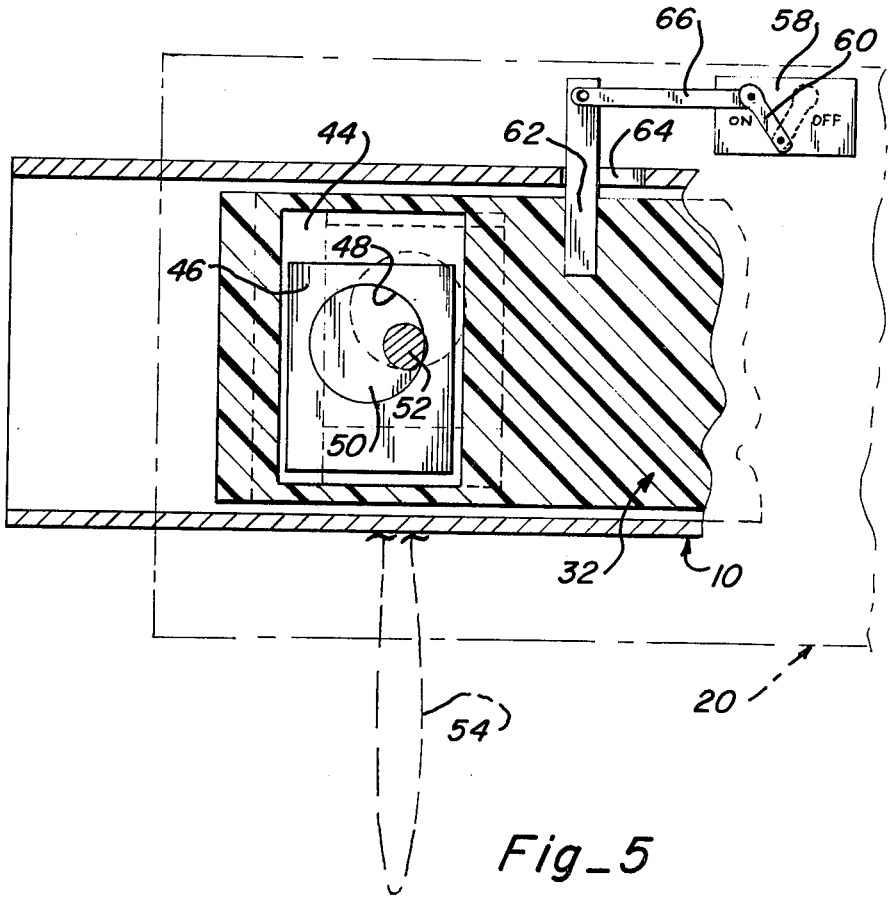
FIG. 5 is a diagrammatic view, partly in section, of the actuating and alarm devices.

Any suitable conventional actuating means may be used to move the locking member between its first and second positions. One such type is illustrated in FIG. 5. A rectangular opening 44 is formed in the end portion of member 32 to receive a slide block 46 having an aperture 48 to receive a cylindrical actuator 50. The latter is mounted eccentrically on shaft 52 rotatably mounted in tubular member 10, and the shaft is driven by handle 54. When the handle is swung clockwise to a horizontal position, actuator 50 moves to the broken line position, driving the slide block and member 32 to the right as shown. In the solid line position actuator 50 is longitudinally aligned with the shaft and the mechanism is self-locking so that member 32 cannot be moved to release position by pulling on the guard members. In addition, the mechanism is provided with a key lock 56 and each authorized operator carries a key on his person to maintain the system in locked position when it is unattended.

Alarm means are provided to alert store personnel if any guard member is not connected properly or if any shoplifter attempts to remove an article when the system is in locked condition. The alarm device 20 includes a casing which contains a conventional electrically powered apparatus which is arranged to emit a warning signal either visually or audibly, or both, when the circuit to which it is connected is interrupted either intentionally or otherwise. Since it should not function when the system is in unlocked condition the actuating means is used to control the electrical power supply to the unit. As seen in FIG. 5, a switch box 58 is provided in casing 20 with an ON-OFF lever 60. A pin 62 fixed in member 32 travels in slot 64 and is connected to lever 60 by link 66. When member 32 moves to locking position the power supply is connected and when it moves to unlocking position the power supply is disconnected.

Returning to FIG. 3, guard member 14 includes a strand of conductive metal 68, such as aircraft cable, with a plastic covering 70. A collar 72 is fixed on each free end of the cable, and fits tightly in socket 74 in head 28 to form a permanent assembly. Strand 68 is exposed at the tip of the head and may be furnished with a metal cap or button if desired. Head 28 and stem 30 are formed of non-conducting plastic material or they may be made of metal provided with a non-conducting coating.

A series of slender elongate resilient electrical conductors 76 are individually mounted adjacent their mid portions in end-to-end relation in locking member 32, with an end portion 78 of one conductor overlying the inner end of a first pocket 40 of a cooperative pair and an end portion 78 of the next conductor overlying the inner end of the second pocket 40 of the same pair, the end portions meeting in conductive contact at a locus between the two pockets. Preferably each conductor is in the form of a leaf spring and is provided with contact buttons 80 and 82. The series extends lengthwise to overlie the longitudinal extent of all of the pockets, and in the absence of any guard member heads all of the buttons 80 will be in contact and a circuit will be complete throught the length of the series.

The alarm device 20 is provided with a first terminal 84 and a second terminal 86. A wire 88 connects the terminal 84 to the first conductor of the series. A second wire connected to the last conductor in the series may complete the return path to terminal 86. However, member 10 is preferably steel tubing and, therefore, it is preferred to connect a wire 90 between the last conductor in the series and member 10 and to connect another wire 92 between member 10 and second terminal 86. Thus there is a complete circuit through the locking means and the alarm device.

When a pair of heads 28 are properly inserted through apertures 26 and into pockets 40, as in the right hand pair of FIG. 3 they extend inward far enough to spring both conductors inward and apart, thus breaking the circuit between buttons 80. However, each end of strand 68 contacts a button 82 and the circuit is again made complete through the strand, and no alarm will be given when the system is locked.

In the event that the operator inserts one head, as shown in the middle portion of FIG. 3, and fails to insert the other, contacts 80 will be separated and the circuit broken. Since the second head is separated from its conductor a new circuit is not completed. When the system is locked the warning signal will be emitted and the operator will be alerted to his error.

If all of the guard members in use are properly seated, as in the right hand portion of FIG. 3, the circuit will be complete and the alarm device will not act when the system is locked. However, if a shoplifter in attempting to steal an article used a tool to cut the cable of a guard member the circuit will be broken and the warning signal will be given immediately.

Figure 6:
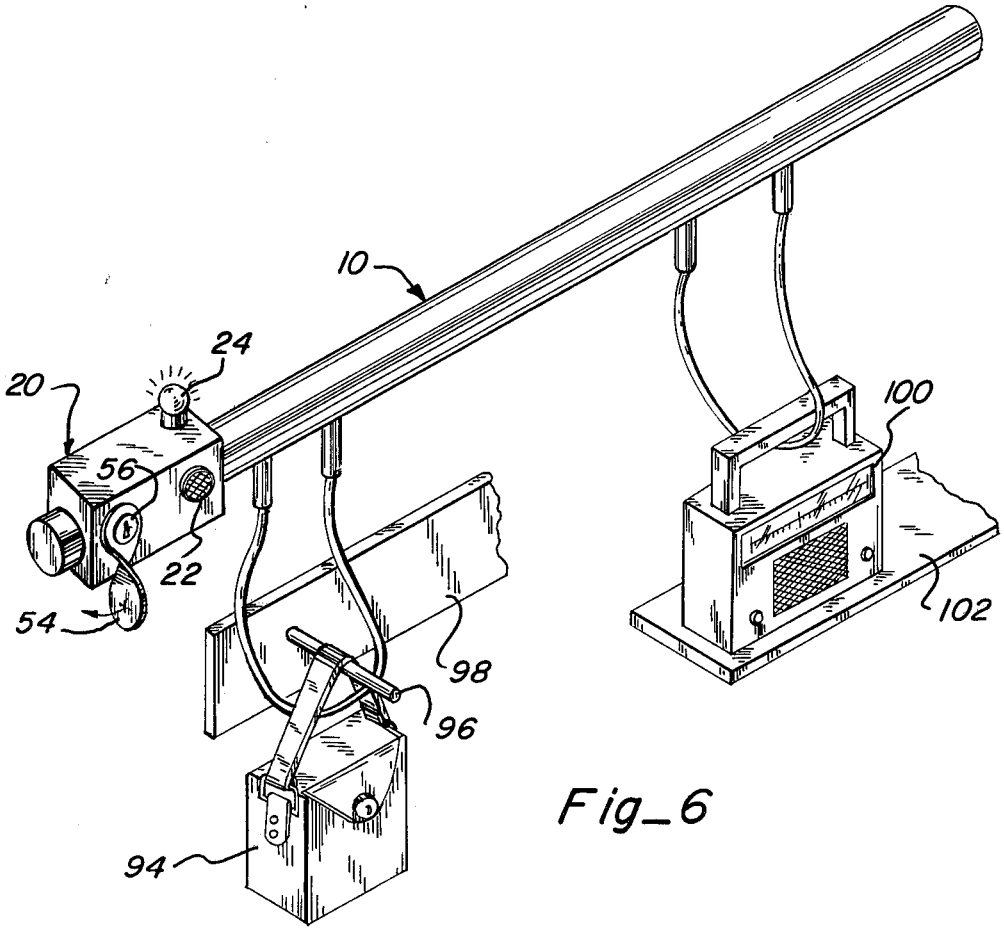
FIG. 6 is a view similar to FIG. 1 showing the system used with articles other than garments.

FIG. 6 illustrates an installation in which the security system is identical but member 10 is not used as a garment support. It may be mounted on a wall or under a counter. A first article 94 is hung by its closed loop handle on a pin 96 carried by a wall bracket 98. A second article 100 is mounted on a counter type support 102. In each case the guard members 14 are passed through the closed loop handles and their heads are locked within member 10 in the manner described above.

What is claimed is:

1. A security system for releasably securing a plurality of articles of merchandise in a display, comprising:

an elongate tubular member provided with a plurality of longitudinally spaced apertures extending through its wall;

locking means mounted within the tubular member including a plurality of outward opening receivers spaced longitudinally to correspond with the spacing of the apertures and to lie in registry with them;

a plurality of individual elongate flexible guard members, each provided with an enlarged head at each end, adapted to be passed through a closed loop portion of an article of merchandise with the heads entering through a selected pair of apertures in the tubular member and into the corresponding registered receivers; and an actuating means to change the relative position of the tubular member and at least a portion of the locking means by displacing at least that portion of the locking means which includes the receivers, and positively transfering the guard member heads to off-center positions with respect to the apertures to prevent removal of the heads from the tubular member;

the operation of the actuating means being reversible to release the heads.

2. A system as claimed in claim 1, in which the locking means comprises an elongate locking member mounted within the tubular member for relative movement and extends throughout the major portion of the length of the tubular member;

the receivers comprise pockets formed in the locking member lying in registry with the apertures in a first position of the locking member and in displaced relation with respect to the apertures in a second position of the locking member;

and the actuating means is operable to displace the locking member to its second position to prevent removal of the heads, and to return it to its first position to release the heads for removal.

3. A system as claimed in claim 2, in which the actuating means moves the locking member axially to produce longitudinal mismatch of the pockets and the apertures and reduce the effective exit paths to sizes less than the sizes of the heads.

4. A system as claimed in claim 2, in which the pockets are provided with means to releasably retain the heads in seated position.

5. A system as claimed in claim 4, in which the retaining means comprise resilient lips on the pockets with entrance openings smaller than the lateral dimensions of the heads.

6. A system as claimed in claim 5, in which the heads are spherical and the inner walls of the lips have approximately the same radius of curvature as that of the heads.

7. A system as claimed in claim 2, in which the apertures in the tubular member are of substantially uniform size, and the heads are dimensioned to pass through the apertures with working clearance.

8. A system as claimed in claim 2, in which the heads are provided with relatively rigid stems overlying the end portions of the flexible guard members to provide grips for inserting the heads in the pockets and removing them.

9. A system as claimed in claim 2, in which the tubular member is provided with elongate vertical floor standards adjacent to its ends to enable it to serve as a primary rack for supporting articles of merchandise.

10. A system as claimed in claim 2, in which each guard member is formed of metallic cable to resist deliberate breakage and provided with a plastic covering to prevent damage to articles secured thereby.

11. A system as claimed in claim 2, in which the actuating means is mechanically selflocking in the second position of the locking member and is provided with a key lock to prevent manual release.

12. A system as claimed in claim 2, in which each successive two apertures along the length of the tubular member and their corresponding pockets constitute a cooperative pair of securing devices to receive the heads of a selected guard member;

the pockets open inward as well as outward;

a series of slender elongate resilient electrical conductors are individually mounted adjacent their mid portions in end-to-end relation in the locking member, with an end portion of one conductor overlying the inner end of a first pocket of a cooperative pair and an end portion of the next conductor overlying the inner end of the second pocket of the same pair, the end portions of the two conductors meeting in conductive contact at a locus between the first and second pockets;

the series extends lengthwise to overlie the longitudinal extent of all of the pockets in the locking member;

an electrically powered alarm device has a first terminal connected to the first conductor in the series, and a return path conductive member is connected to the last conductor in the series and to a second terminal on the alarm device to complete a circuit;

the alarm device in enabled condition is arranged to emit a warning signal in response to occurrence of an open circuit;

the guard member comprises a strand of conductive metal;

the heads in fully seated position in the pockets extend inward sufficiently to spring the contacting ends of the adjacent conductors inward and apart and open the electrical circuit;

and the ends of the conductive strands contact the end portions of their respective conductors and complete a conductive path between them to maintain a closed circuit through the alarm device.

13. A system as claimed in claim 12, in which the tubular member is composed of conductive metal and serves as the return path member;

and at least the surface of each head is of nonconducting material.

14. A system as claimed in claim 12, in which the location in its pocket of only one head of a given guard member displaces its respective conductor end portion to open the circuit through the conductors;

and the separation of the other head from its respective conductor end portion precludes completion of the circuit.

15. A system as claimed in claim 12, in which operation of the actuating means to move the locking member to its first position disables the alarm device from emitting a signal;

and operation of the actuating means to move the locking member to its second position enables the alarm device to emit a signal in response to occurrence of an open circuit.

16. A system as claimed in claim 12, in which severance of a guard member with both of its heads locked in their respective pockets opens the circuit and causes the alarm device to emit a signal.

* * * * *